US011688272B2

(12) United States Patent
Bergman et al.

(10) Patent No.: US 11,688,272 B2
(45) Date of Patent: Jun. 27, 2023

(54) SYSTEMS AND METHODS OF ALTERNATING TRANSMITTER FOR METAL FOIL DETECTION NEAR MOVING DOORS

(71) Applicant: Sensormatic Electronics, LLC, Boca Raton, FL (US)

(72) Inventors: Adam S. Bergman, Boca Raton, FL (US); John A. Allen, Pompano Beach, FL (US)

(73) Assignee: SENSORMATIC ELECTRONICS, LLC, Boca Raton, FL (US)

( * ) Notice: Subject to any disclaimer, the term of this patent is extended or adjusted under 35 U.S.C. 154(b) by 116 days.

(21) Appl. No.: 17/210,281

(22) Filed: Mar. 23, 2021

(65) Prior Publication Data

US 2022/0028251 A1 Jan. 27, 2022

Related U.S. Application Data

(60) Provisional application No. 63/056,980, filed on Jul. 27, 2020.

(51) Int. Cl.
*G08B 26/00* (2006.01)
*G08B 21/18* (2006.01)

(52) U.S. Cl.
CPC ..... *G08B 26/007* (2013.01); *G08B 21/182* (2013.01)

(58) Field of Classification Search
USPC ..... 340/505, 506, 539.13, 539.22, 539.26, 340/545.1, 547, 545.6, 545.7, 545.8, 340/545.9, 568.1, 588, 636.11, 340/572.1–572.9
See application file for complete search history.

(56) References Cited

U.S. PATENT DOCUMENTS 6,020,856 A 2/2000 Alicot
7,177,659 B2 * 2/2007 Cho ..... H03G 3/3042 455/127.1
8,587,489 B2 * 11/2013 Oung ..... H01Q 1/2216 343/788

(Continued)

FOREIGN PATENT DOCUMENTS

AU 2011249049 B2 11/2015
WO 2008028487 A1 3/2008

OTHER PUBLICATIONS

International Search Report and Written Opinion issued in corresponding International Application No. PCT/US2021/024017 dated Jul. 15, 2021.

*Primary Examiner* — Daniel Previl
(74) *Attorney, Agent, or Firm* — ArentFox Schiff LLP

(57) ABSTRACT

A system may include a security controller communicatively coupled with pedestals having a first set of antennas and a second set of antennas spaced from the first set of antennas to form an interrogation zone. The security controller may be configured to alternate transmission and reception of interrogation signals between the first set of antennas and the second set of antennas. The security controller may be configured to determine whether a metal object is detected in the interrogation zone in response to the reception of the interrogation signals by the second set of antennas or by the first set of antennas. The security controller may be configured to generate and send an alarm signal in response to the metal object being detected in the interrogation zone.

19 Claims, 6 Drawing Sheets

(56) References Cited

U.S. PATENT DOCUMENTS

| | | | | |
|---|---|---|---|---|
| 8,676,141 | B1 * | 3/2014 | Vargantwar | H04W 52/42 375/267 |
| 2002/0115417 | A1 * | 8/2002 | Haapakoski | H03F 3/19 455/115.3 |
| 2006/0164240 | A1 | 7/2006 | Patchell | |
| 2012/0112918 | A1 * | 5/2012 | Dinh | G01V 3/10 324/228 |
| 2013/0285855 | A1 * | 10/2013 | Dupray | H04W 4/021 342/451 |
| 2013/0309980 | A1 * | 11/2013 | Seth | H04B 17/12 455/77 |
| 2016/0260304 | A1 * | 9/2016 | Yang | G06K 7/10336 |

* cited by examiner

SYSTEMS AND METHODS OF ALTERNATING TRANSMITTER FOR METAL FOIL DETECTION NEAR MOVING DOORS

CROSS-REFERENCE TO RELATED APPLICATIONS

This application claims the benefit of U.S. Provisional Application Ser. No. 63/056,980, entitled "SYSTEMS AND METHODS OF ALTERNATING TRANSMITTER FOR METAL FOIL DETECTION NEAR MOVING DOORS" and filed on Jul. 27, 2020, which is expressly incorporated by reference herein in its entirety.

BACKGROUND

The present disclosure relates generally to security systems, and more particularly, to systems and methods of alternating a transmitter for metal foil detection near moving doors.

Typical electronic article surveillance (EAS) systems initiate an EAS alarm when an individual that is shoplifting enters an interrogation zone while leaving a retail store with an unpurchased product. In some EAS systems, a metal detector is included and used by the EAS system to detect metal objects in the interrogation zone. However, these EAS systems can signal false EAS alarms due to the metal detector detecting movement by metal doorways.

Accordingly, improvements in EAS systems are desired.

SUMMARY

This summary is provided to introduce a selection of concepts in a simplified form that are further described below in the DETAILED DESCRIPTION. This summary is not intended to identify key features of the claimed subject matter, nor is it intended to be used as an aid in determining the scope of the claimed subject matter.

In an aspect, a security system is disclosed. The security system may include a plurality of pedestals comprising a first set of antennas and a second set of antennas spaced from the first set of antennas to form an interrogation zone. The security system may include a security controller communicatively coupled with the plurality of pedestals. The security controller may be configured to alternate transmission of interrogation signals between the first set of antennas and the second set of antennas. The security controller may be configured to alternate reception of the interrogation signals between the second set of antennas and the first set of antennas to coordinate with the transmission of the interrogation signals. The security controller may be configured to determine whether a metal object is detected in the interrogation zone in response to the reception of the interrogation signals by the second set of antennas or by the first set of antennas The security controller may be configured to generate and send an alarm signal in response to the metal object being detected in the interrogation zone.

In another aspect, a method of controlling a security system is disclosed. The method may include a plurality of pedestals with a first set of antennas and a second set of antennas spaced from the first set of antennas to form an interrogation zone. The method may include alternating transmission of interrogation signals between the first set of antennas and the second set of antennas. The method may include alternating reception of the interrogation signals between the second set of antennas and the first set of antennas to coordinate with the transmission of the interrogation signals. The method may include determining whether a metal object is detected in the interrogation zone in response to the reception of the interrogation signals by the second set of antennas or by the first set of antennas. The method may include generating and sending an alarm signal in response to the metal object being detected in the interrogation zone.

In another aspect a computer-readable medium storing computer executable instructions of controlling a security system is disclosed. The computer-readable medium may include instructions to alternate transmission of interrogation signals by a first set of antennas of a plurality of pedestals to a second set of antennas of the plurality of pedestals spaced from the first set of antennas to form an interrogation zone and by the second set of antennas to the first set of antennas. The computer-readable medium may include instructions to alternate reception of the interrogation signals between the second set of antennas and the first set of antennas to coordinate with the transmission of the interrogation signals. The computer-readable medium may include instructions to determine whether a metal object is detected in the interrogation zone in response to the reception of the interrogation signals by the second set of antennas or by the first set of antennas. The computer-readable medium may include instructions to generate and send an alarm signal in response to the metal object being detected in the interrogation zone.

Further aspects of the present disclosure are described in more details below.

BRIEF DESCRIPTION OF THE DRAWINGS

The disclosed aspects will hereinafter be described in conjunction with the appended drawings, provided to illustrate and not to limit the disclosed aspects, wherein like designations denote like elements, and in which.

DETAILED DESCRIPTION

Figure 1:
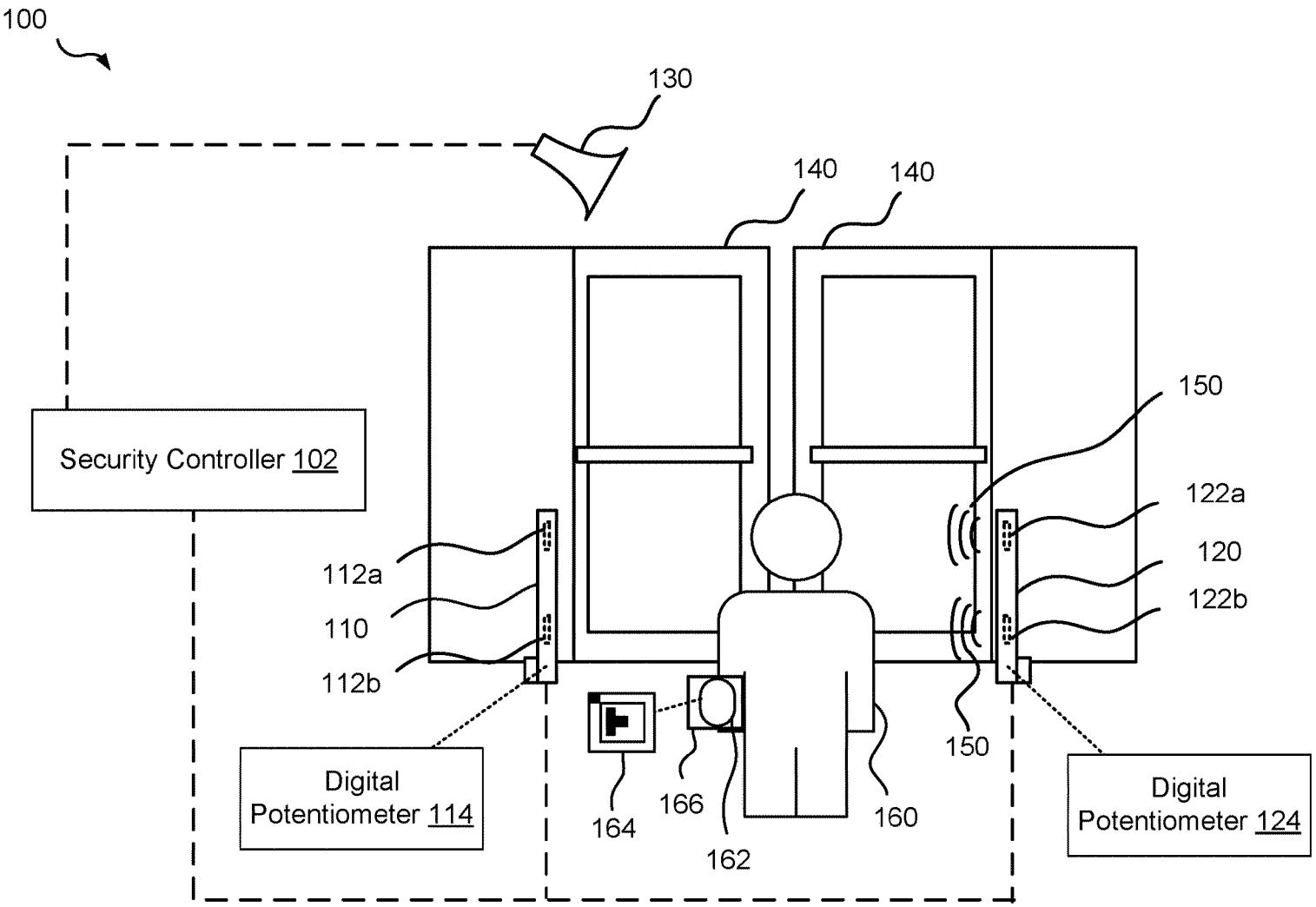
FIG. 1 is a conceptual diagram of an example security system, according to aspects of the present disclosure.

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known components may be shown in block diagram form in order to avoid obscuring such concepts.

Electronic article surveillance ("EAS") systems are commonly used in retail stores and other settings to prevent the unauthorized removal of merchandise from a protected area. Typically, a detection system is used at an exit of the protected area and includes a first pedestal having an antenna and transmitter that generate an electromagnetic field across the exit, known as an interrogation zone. Protected merchandise are tagged with an EAS marker (or electronic tag) that, when activated by the electromagnetic field in the interrogation field, generates an electromagnetic response signal. An antenna and receiver in a second pedestal detect this response signal and generate an alarm.

Because of the nature of this process, other magnetic materials or metal, such as metal doors or metal shopping carts, in proximity to the EAS marker or the transmitter may interfere with the optimal performance of the EAS system. Further, some individuals utilize EAS marker shielding, such as bags that are lined with metal foil, with the intention to shoplift protected merchandise without detection from any EAS system. The metal lining of these bags can shield tagged merchandise from the EAS detection system and/or impact detection of EAS markers.

Typically, to reduce interference and/or false positives from metal doors, an EAS system with a metal detector may be distanced from the metal doors or use a door positioning system to determine a position of the metal doors to mitigate the effects of movement of the doors on the EAS systems.

The present disclosure addresses one or more shortcomings of a conventional EAS system by providing systems and methods of alternating the transmitters and the receivers between pedestals to cover an interrogation zone while using lower gain settings for the receiver. By utilizing the alternating between pedestals, metal doors and moving metal doors may have less effect on the receivers since the gain needed is much lower than with a typical EAS system including a metal detector. Further, an alternating pedestal method may be used in conjunction with a digital potentiometer such that top and bottom coils may be nulled while the door is moving, thereby minimizing the effects from the moving door on the receiver.

Turning now to the figures, example aspects are depicted with reference to one or more components described herein, where components in dashed lines may be optional.

Referring to FIG. 1, an example security system 100 deployed at an establishment (e.g., store) is depicted. The security system 100 may include a security controller 102 configured to control the plurality of components and subsystems of the security system 100.

The security system 100 may also include a plurality of pedestals 110 and 120 communicatively coupled with the security controller 102. While the examples provided herein describe the security system 100 using pedestals 110 and 120, one skilled in the art would recognized that other structures (e.g., walls, posts), movable or fixed, may be used to implement the systems and methods described herein. In an aspect, the plurality of pedestals 110 and 120 are positioned near the exit doors 140 of the establishment. The pedestals 110 and 120 may be spaced from each other to form an interrogation zone (e.g., area formed between the plurality of pedestals 110 and 120) that an individual 160 passes through before exiting through the exit doors 140 of the establishment. Each of the pedestals 110 and 120 may include a plurality of antennas 112*a*, 112*b*, 122*a*, and 122*b* (or coils) for generating interrogation signals 150 (e.g., electromagnetic fields) to detect an electronic tag 164 on merchandise 162 carried by the individual 160 through the interrogation zone. Examples of the electronic tag 164 include, but are not limited to, a radio frequency identifier (RFID) tag, an acousto-magnetic tag, or any other type of EAS devices on the merchandise 162. In an aspect, the interrogation signals 150 may also be used to detect a metal object 166, such as a bag lined with metal foil for covering the merchandise 162.

The security system 100 may also include an alarm device 130 communicatively coupled with the security controller 102 and configured to generate an alarm to alert personnel, such as employees of the retail store, police officers, security guards, or any other person, to the unauthorized removal of the merchandise 162 with or without the metal object 166. In example, the alarm device 130 generates the alert in response to receiving an alarm signal from the security controller 102. Examples of the alarm device 130 may include one or more of an audio alarm device (e.g., horn), a visual alarm device (e.g., light), a computing device (e.g., personal computer, laptop, mobile device) that receives messages such as text or email (or any form of communication), or any other device capable of alerting personnel of the unauthorized removal of the merchandise 162. In an example, the alarm device 130 may be located at the same location (e.g., retail store) as the pedestals 110 and 120 and/or may be located remote to the location.

In an example, the security controller 102 may null interference from the moving exit doors 140. For example, the security system 100 may also include one or more digital potentiometers 114 and 124 communicatively coupled with the security controller 102 and the plurality of antennas 112*a*, 112*b*, 122*a*, and 122*b*. In an example, the plurality of digital potentiometers 114 and 124 may be configured to match signal levels of received interrogation signals 150 to take into account movement of the exit doors 140. In an aspect, the plurality of digital potentiometers 114 and 124 may be calibrated, for example, at a time of installation. During calibration, a number of calibrations (e.g., 5) may be performed to match signal levels of received interrogation signals 150 to allow the plurality of digital potentiometers 114 and 124 to come to a steady state. Once calibrated, the exit doors 140 may no longer cause excessive differences between the received interrogation signals 150. Further, once calibration has completed, the security controller 102 may determine an absolute value of the difference between the received interrogation signals 150 and compare the absolute value to a threshold. In an example, if the absolute value is greater than the threshold, the security controller 102 may transmit the alarm signal to the alarm device 130. Otherwise, the alarm signal is not transmitted.

Figure 2:
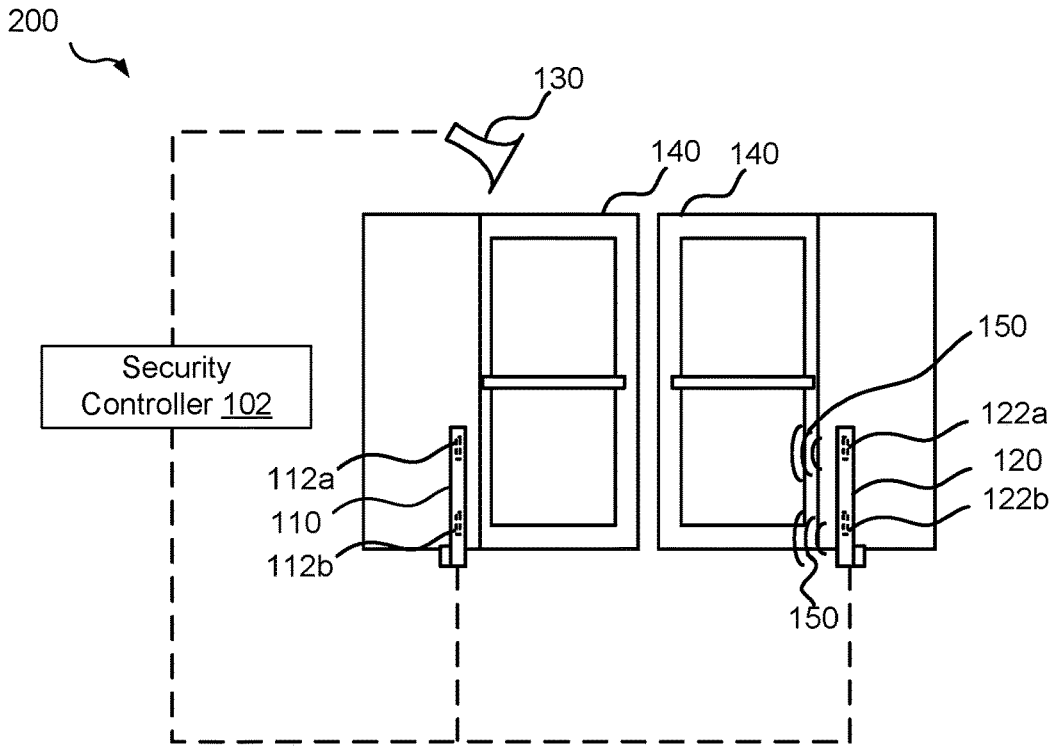
FIG. 2 is a conceptual diagram of an example implementation of the security system of FIG. 1, according to aspects of the present disclosure.
Figure 2:
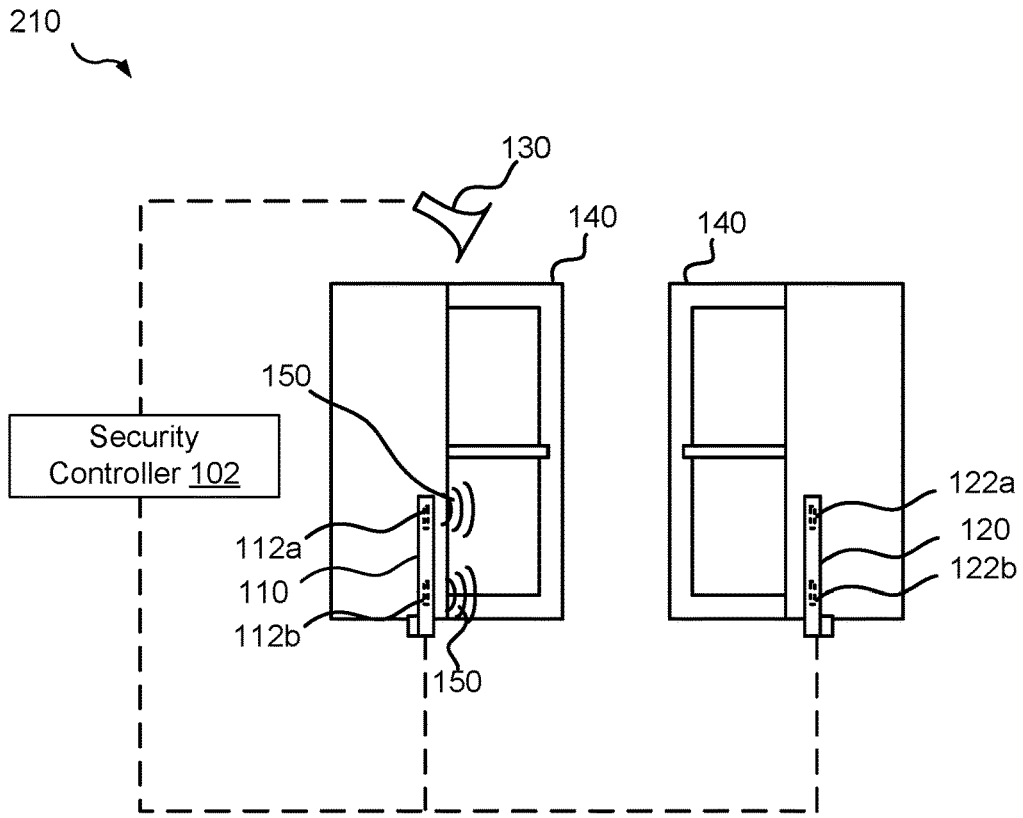

Referring to FIG. 2, conceptual examples of the security system 100 being controlled by the security controller 102 is illustrated. In an aspect, the security controller 102 may alternate the transmission and reception of the interrogation signals 150 between the pedestals 110 and 120. For example, the security controller 102 may alternate between a first operation 200 and a second operation 210. In the first operation 200, the security controller 102 may control the antennas 122*a* and 122*b* of the pedestal 120 to emit the interrogation signals 150 and the antennas 112*a* and 112*b* of the pedestal 110 to receive the interrogation signals 150. In the second operation 210, the security controller 102 may control the antennas 112*a* and 112*b* of the pedestal 110 to emit the interrogation signals 150 and the antennas 122*a* and 122*b* of the pedestal 120 to receive the interrogation signals 150. Alternatively, in the first operation 200, the security controller 102 may control the antennas 112*a* and 122*b* to emit the interrogation signals 150 and the antennas 112*b* and 122*a* to receive the interrogation signals 150. In the second operation 210, the security controller 102 may control the antennas 112*b* and 122*a* to emit the interrogation signals 150 and the antennas 112*a* and 122*b* to receive the interrogation signals 150.

In some examples, the antenna 112*a* is vertically positioned above the antenna 112*b* and the antenna 122*a* is vertically positioned above the antenna 122*b*. However, the antennas may be positioned according to other arrangements respective to each in order to alternately transmit and receive the interrogation signals 150.

In an aspect, the security controller 102 may determine whether the metal object 166 is within the interrogation zone based on a difference in signal levels (or transmit energy) of the received interrogation signals 150. For example, the security controller 102 may determine the difference between a signal level of a received interrogation signal 150 received by a first antenna (e.g., antenna 112*a*) and a signal level of a received interrogation signal 150 received by a second antenna (e.g., antenna 112*b*). The security controller 102 may also compare the difference of the signal levels to a threshold to determine whether the metal object 166 is present in the interrogation zone. In an example, when the difference between the signal levels is greater than the threshold, the security controller 102 may determine the metal object 166 is within the interrogation zone. Otherwise, the security controller 102 determines the metal object 166 is not present. In an example, an absolute value of the difference between the signal levels may be used by the security controller to compare with the threshold.

In response to determining that the metal object 166 is present, the security controller 102 may generate and send an alarm signal to the alarm device 130. In an example, the alarm signal may be one or more of a control signal to control an audio alarm device or a visual alarm device or a message a message (including text, email, etc.) for a computing device.

Figure 3:
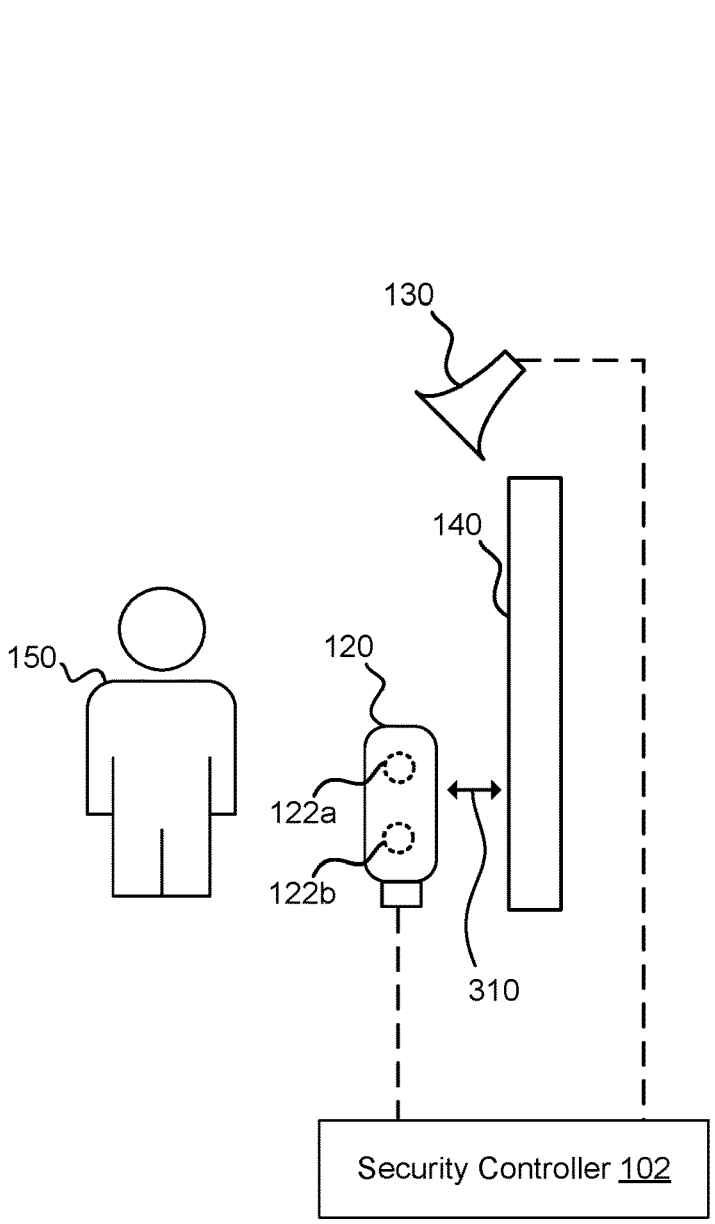
FIG. 3 is another conceptual diagram of an example implementation of the security system of FIG. 1, according to aspects of the present disclosure.

Referring to FIG. 3, by alternating the transmission and reception of the interrogation signals 150 between the antennas 112*a*, 112*b*, 122*a*, and 122*b*, only half of the interrogation zone may be covered by each antenna, as compared to a typical EAS system. However, alternating transmission/reception may allow the security system 100 to lower the gain on the transmission of the interrogation signal 150 thereby allowing the pedestals 110 and 120 to be placed within a close proximity 310 to the exit doors 140, as compared to a typical EAS system. Further, use of the alternating transmission/reception in combination with one or more of the digital potentiometers 114 and 124 may null the effect of the movement (e.g., sliding movement) of the metal on the exit doors 140 during calibration, as described herein.

In an example, the security controller 102 may determine an absolute value of the difference between the received interrogation signals 150 and compare the absolute value to a threshold. If the absolute value is greater than the threshold, the security controller 102 may transmit the alarm signal to the alarm device 130. Otherwise, the alarm signal is not transmitted.

Figure 4:
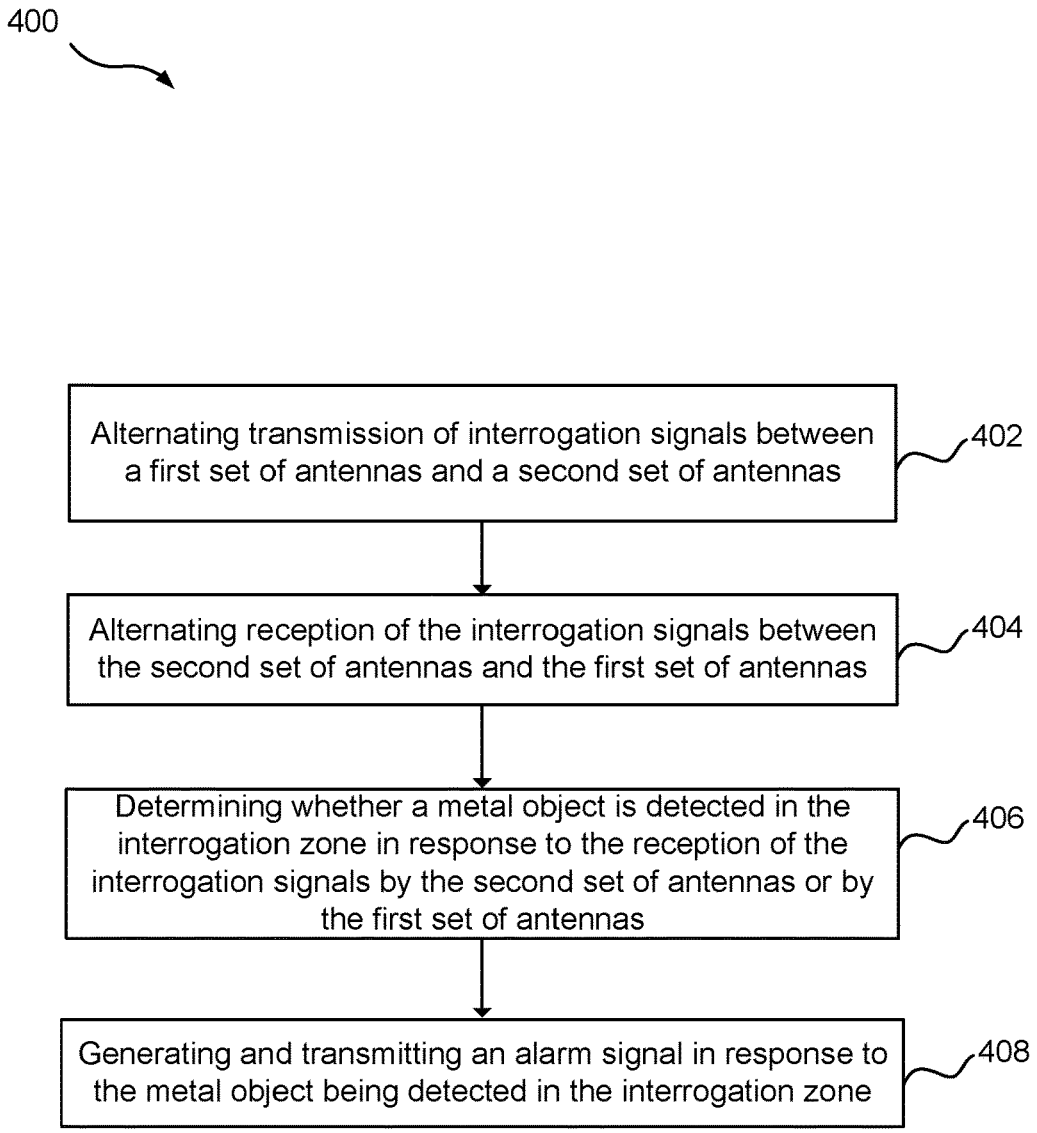
FIG. 4 is a flowchart of an example method implemented by the security system of FIG. 1, according to aspects of the present disclosure.

Referring to FIG. 4, an example method 400 of controlling the security system 100 is depicted. The operations of the method 400 may be performed by one or more components of the security system 100, as described herein.

At 402, the method 400 may include alternating transmission of interrogation signals between a first set of antennas and a second set of antennas. For example, the security controller 102 may alternate transmission of the interrogation signals 150 between the antennas 112*a* and 112*b* of the pedestal 110 and the antennas 122*a* and 122*b* of the pedestal 120. In another example, the security controller 102 may alternate transmission of the interrogation signals 150 between the antennas 112*a* and 122*b* and the antennas 112*b* and 122*a*.

At 404, the method 400 may also include alternating reception of the interrogation signals between the second set of antennas and the first set of antennas to coordinate with the transmission of the interrogation signals. For example, the security controller 102 may alternate reception of the interrogation signals 150 between the antennas 122*a* and 122*b* and the antennas 112*a* and 112*b* such that the antennas 122*a* and 122*b* receive the transmission of the interrogation signals 150 from the antennas 112*a* and 112*b* and the antennas 112*a* and 112*b* receive the transmission of the interrogation signals 150 from the antennas 122*a* and 122*b*. In another example, the security controller 102 may alternate transmission of the interrogation signals 150 between the antennas 112*b* and 122*a* and the antennas 112*a* and 122*b* such that the antennas 112*b* and 122*a* receive the transmission of the interrogation signals 150 from the antennas 112*a* and 122*b* and the antennas 112*a* and 122*b* receive the transmission of the interrogation signals 150 from the antennas 112*b* and 112*a*.

At 406, the method 400 may include determining whether a metal object is detected in the interrogation zone in response to the reception of the interrogation signals by the second set of antennas or by the first set of antennas. For example, the security controller 102 may determine whether the metal object 166 is detected in the interrogation zone by determining a difference between signal levels of the interrogation signals 150. Further, the security controller 102 may compare the difference between the signal levels to a threshold. In an example, when the difference is greater than the threshold, the security controller 102, the security controller 102 may determine the metal object 166 is within the interrogation zone. Otherwise, the security controller 102 determines the metal object 166 is not present.

At 408, the method 400 may include generating and sending an alarm signal in response to the metal object being detected in the interrogation zone. For example, in response to the metal object 166 being detected in the interrogation zone, the security controller 102 may generate one or more signals for an audio alarm device, a visual alarm device, or a message (including text, email, etc.) for a computing device, and send the alarm signal to the alarm device 130 to cause the audio alarm, the visual alarm, or display of the message.

In some examples, the method 400 may include nulling the first set of antennas or the second set of antennas by a digital potentiometer in response to the reception of the interrogation signals and the indication. For example, in response to the indication, the security controller 102 may utilize one or more digital potentiometers 114 and 124 to null the received interrogation signals 150 such that the security system 100 is not effected by the moving exit doors 140.

Figure 5:
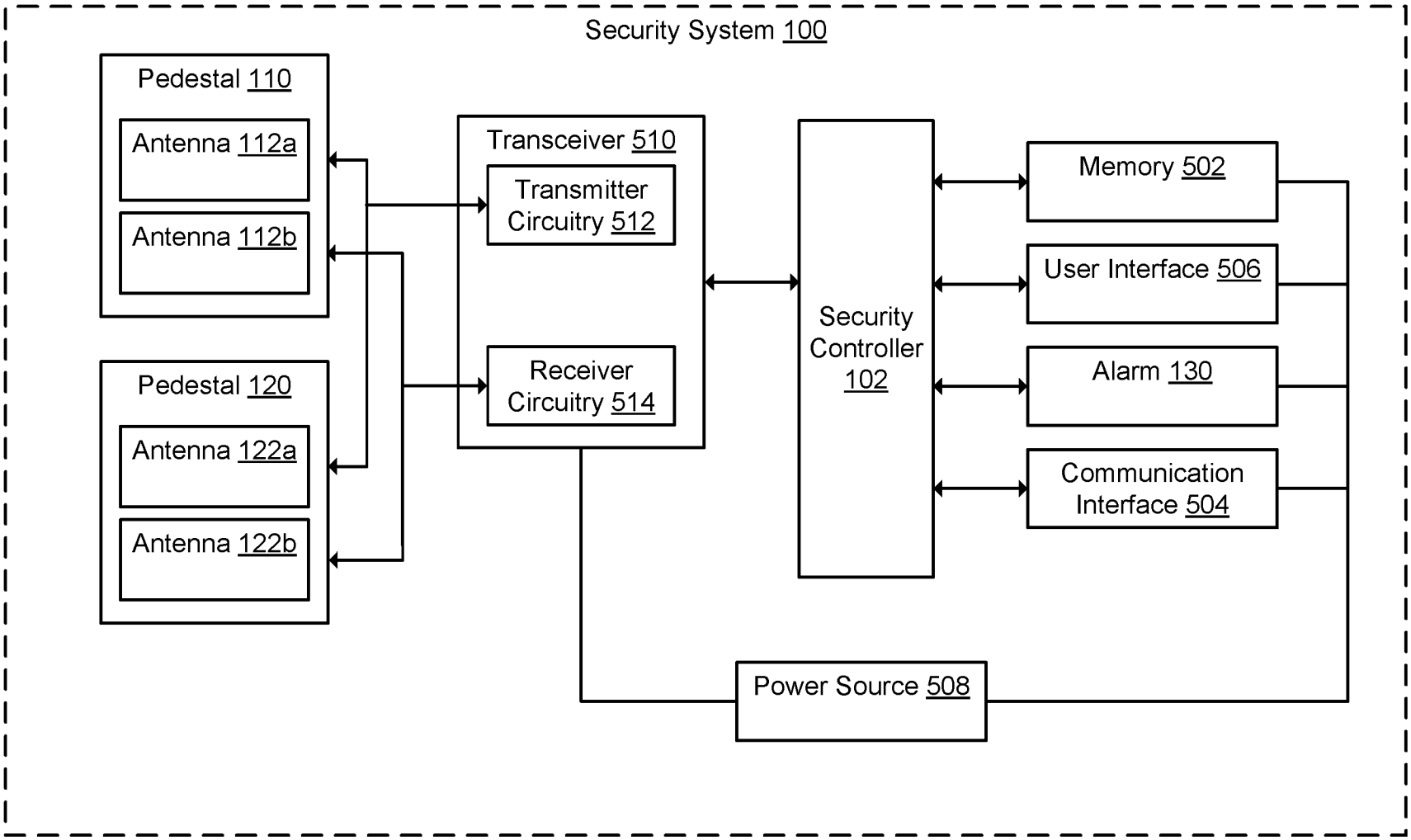
FIG. 5 is a block diagram of the example security system of FIG. 1 including various hardware components and other features, according to aspects of the present disclosure.

Referring to FIG. 5, an exemplary security system 100 to implement all or a portion of the functionality described in FIGS. 1-4. For example, the security system 100 may be or may include any components described herein with reference to FIGS. 1-4. The security system 100 may include the security controller 102 which may be configured to execute or implement software, hardware, and/or firmware modules that perform some or all of the functionality described herein with reference to FIGS. 1-4.

The security controller 102 may be one or more processors, micro-controllers, application-specific integrated circuits (ASICs), or field-programmable gate array (FPGAs), and/or may include a single or multiple set of processors or multi-core processors. Moreover, the security controller 102 may be implemented as an integrated processing system and/or a distributed processing system.

The security system 100 may further include a memory 502 (or computer-readable medium including non-transitory medium), such as for storing local versions of applications and media being executed by the security controller 102, related instructions, parameters, etc. The memory 502 may include a type of memory usable by a computer, such as random access memory (RAM), read only memory (ROM), tapes, magnetic discs, optical discs, volatile memory, non-volatile memory, removable storage devices (e.g., program cartridge and cartridge interface or a removable memory chip), and any combination thereof. Additionally, the security controller 102 and the memory 502 may include and execute an operating system executing on the security controller 102, one or more applications, display drivers, etc., and/or other components of the security system 100.

Further, the security system 100 may include a communications interface 504 that provides for establishing and maintaining communications with one or more other devices, parties, entities, etc. utilizing hardware, software, and services. The communications interface 504 may carry communications between components of the security system 100, as well as between the security system 100 and external devices, such as devices located across a communications network and/or devices serially or locally connected to the security system 100. In an aspect, for example, the communications interface 504 may include one or more buses, and may further include transmit chain components and receive chain components associated with a wireless or wired transmitter and receiver, respectively, operable for interfacing with external devices.

The security system 100 may also include a user interface 506 operable to receive inputs from a user of the security system 100 and further operable to generate outputs for presentation to the user (e.g., via a display interface to a display device). The security system 100 may include one or more input devices, including but not limited to a keyboard, a number pad, a mouse, a touch-sensitive display, a navigation key, a function key, a microphone, a voice recognition component, or any other mechanism capable of receiving an input from a user, or any combination thereof. Further, the security system 100 may include one or more output devices, including but not limited to the alarm device 130, a display interface, a speaker, a haptic feedback mechanism, a printer, any other mechanism capable of presenting an output to a user, or any combination thereof.

The security system 100 may also include a power source 508, such as a battery or AC power, that supplies electricity to components of the security system 100. In an example, power source 508 may include one or more power sources such that any of the components of the security system 100 may be individually powered.

The security system 100 may also include a transceiver 510 for transmitting and receiving signals (e.g., interrogation signals 150). In an example, the transceiver 510 may include transmitter circuitry 512 electrically coupled to the antennas 112*a*, 112*b*, 122*a*, and 122*b*, and receiver circuitry 514 electrically coupled to the antennas 112*a*, 112*b*, 122*a*, and 122*b*. In an example, the transmitter circuitry 512 may transmit radio frequency signals (e.g., interrogation signal 150) and the receiver circuitry 514 may receive the radio frequency signals (e.g., interrogation signal 150) based on control signals from the security controller 102.

Figure 6:
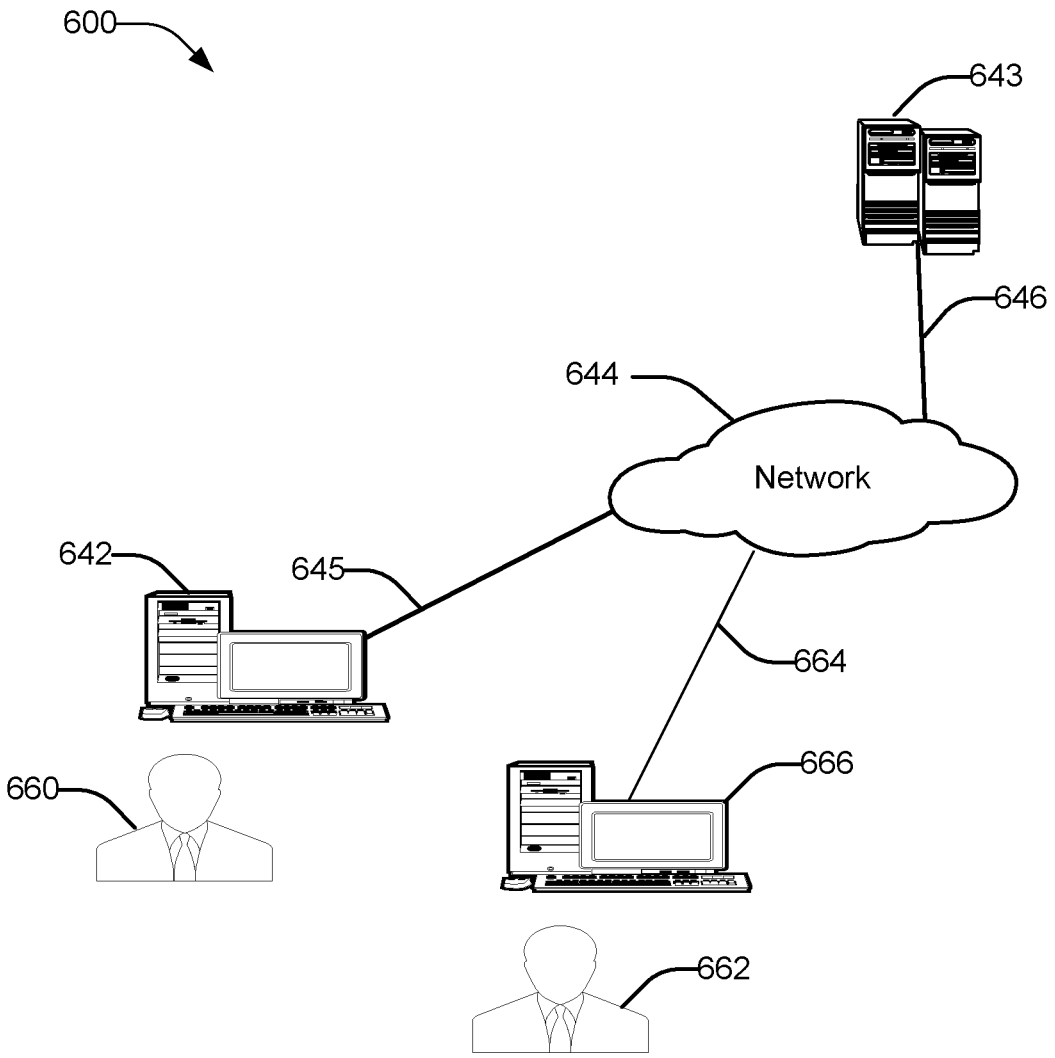
FIG. 6 is a block diagram of various example system components of the security system of FIG. 1, according to aspects of the present disclosure.

FIG. 6 is a block diagram of various example system components. FIG. 6 shows a communication system 600 including one or more accessors 660, 662 (also referred to interchangeably herein as one or more "users") and one or more terminals 642, 666. The terminals 642, 666 may include the security controller 102 or a related system or subsystem, and/or the like. In one aspect, data for use in accordance with aspects described herein may be input and/or accessed by the accessors 660, 662 via the terminals 642, 666, such as personal computers (PCs), minicomputers, mainframe computers, microcomputers, telephonic devices, or wireless devices, such as personal digital assistants ("PDAs") or a hand-held wireless devices coupled to a server 643, such as a PC, minicomputer, mainframe computer, microcomputer, or other device having a processor and a repository for data and/or connection to a repository for data, via, a network 644 for instance, such as the Internet or an intranet, and couplings 645, 646, 664. The couplings 645, 646, 664 may include wired, wireless, or fiberoptic links. In another example variation, the method and system in accordance with aspects described herein operate in a stand-alone environment, such as on a single terminal.

Additional Embodiments

An example security system, comprising: a plurality of pedestals comprising a first set of antennas and a second set of antennas spaced from the first set of antennas to form an interrogation zone; and a security controller communicatively coupled with the plurality of pedestals and configured to: alternate transmission of interrogation signals between the first set of antennas and the second set of antennas; alternate reception of the interrogation signals between the second set of antennas and the first set of antennas to coordinate with the transmission of the interrogation signals; determine whether a metal object is detected in the interrogation zone in response to the reception of the interrogation signals by the second set of antennas or by the first set of antennas; and generate and send an alarm signal in response to the metal object being detected in the interrogation zone.

The above example security system, wherein the security controller is further configured to: determine a difference between signal levels of the interrogation signals at a first antenna of the second set of antennas and a second antenna of the second set of antennas or at a first antenna of the first set of antennas and a second antenna of the first set of antennas; compare the difference between the signal levels to a threshold; and determine whether the metal object is detected in the interrogation zone further in response to the difference between the signal levels being greater than the threshold.

One or more of the above example security systems, wherein the difference between the signal levels is an absolute value of the difference between the signal levels.

One or more of the above example security systems, wherein the first antenna of the first set of antennas is vertically positioned above the second antenna of the first set of antennas and the first antenna of the second set of antennas is vertically positioned above the second antenna of the second set of antennas.

One or more of the above example security systems, further comprising: a plurality of digital potentiometers communicatively coupled with the security controller, the first set of antennas, and the second set of antennas, and configured to null the interrogation signals received by the first set of antennas or the second set of antennas in response to the reception of the interrogation signals via the plurality of digital potentiometers.

One or more of the above example security systems, wherein the plurality of digital potentiometers may be calibrated to null the interrogation signals a number of times by matching signal levels of the interrogation signals received by the first set of antennas or the second set of antennas.

One or more of the above example security systems, further comprising: a first pedestal comprising the first set of antennas; and a second pedestal comprising the second set of antennas.

One or more of the above example security systems, further comprising: a memory storing instructions for controlling the security system, wherein the security controller is one or more processors further communicatively coupled with the memory.

An example method of controlling a security system comprising a plurality of pedestals with a first set of antennas and a second set of antennas spaced from the first set of antennas to form an interrogation zone, the method comprising: alternating transmission of interrogation signals between the first set of antennas and the second set of antennas; alternating reception of the interrogation signals between the second set of antennas and the first set of antennas to coordinate with the transmission of the interrogation signals; determining whether a metal object is detected in the interrogation zone in response to the reception of the interrogation signals by the second set of antennas or by the first set of antennas; and generating and sending an alarm signal in response to the metal object being detected in the interrogation zone.

The above example method, further comprising: determining a difference between signal levels of the interrogation signals at a first antenna of the second set of antennas and a second antenna of the second set of antennas or at a first antenna of the first set of antennas and a second antenna of the first set of antennas; comparing the difference between the signal levels to a threshold; and determining whether the metal object is detected in the interrogation zone further in response to the difference between the signal levels being greater than the threshold.

One or more of the above example methods, wherein the difference between the signal levels is an absolute value of the difference between the signal levels.

One or more of the above example methods, wherein the first antenna of the first set of antennas is vertically positioned above the second antenna of the first set of antennas and the first antenna of the second set of antennas is vertically positioned above the second antenna of the second set of antennas.

One or more of the above example methods, further comprising: nulling the interrogation signals received by the first set of antennas or the second set of antennas in response to the reception of the interrogation signals via a plurality of digital potentiometers communicatively coupled with the first set of antennas and the second set of antennas.

One or more of the above example methods, wherein the plurality of digital potentiometers may be calibrated to null the interrogation signals a number of times by matching signal levels of the interrogation signals received by the first set of antennas or the second set of antennas.

One or more of the above example methods, wherein the first set of antennas are positioned in a first pedestal, and the second set of antennas are positioned in a second pedestal.

An example computer-readable medium storing computer executable instructions of controlling a security system, comprising instructions to: alternate transmission of interrogation signals by a first set of antennas of a plurality of pedestals to a second set of antennas of the plurality of pedestals spaced from the first set of antennas to form an interrogation zone and by the second set of antennas to the first set of antennas; alternate reception of the interrogation signals between the second set of antennas and the first set of antennas to coordinate with the transmission of the interrogation signals; determine whether a metal object is detected in the interrogation zone in response to the reception of the interrogation signals by the second set of antennas or by the first set of antennas; and generate and send an alarm signal in response to the metal object being detected in the interrogation zone.

The above example computer-readable medium, further comprising instructions to: determine a difference between signal levels of the interrogation signals at a first antenna of the second set of antennas and a second antenna of the second set of antennas or at a first antenna of the first set of antennas and a second antenna of the first set of antennas; compare the difference between the signal levels to a threshold; and determine whether the metal object is detected in the interrogation zone further in response to the difference between the signal levels being greater than the threshold.

One or more of the above example computer-readable mediums, wherein the difference between the signal levels is an absolute value of the difference between the signal levels.

One or more of the above example computer-readable mediums, wherein the first antenna of the first set of antennas is vertically positioned above the second antenna of the first set of antennas and the first antenna of the second set of antennas is vertically positioned above the second antenna of the second set of antennas.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. A security system, comprising:

a plurality of pedestals comprising a first set of antennas and a second set of antennas spaced from the first set of antennas to form an interrogation zone; and a security controller communicatively coupled with the plurality of pedestals and configured to:

alternate transmission of interrogation signals between the first set of antennas and the second set of antennas;

alternate reception of the interrogation signals between the second set of antennas and the first set of antennas to coordinate with the transmission of the interrogation signals;

determine whether a metal object is detected in the interrogation zone based on comparing reception of the interrogation signals by the second set of antennas to reception of the interrogation signals by the first set of antennas; and generate and send an alarm signal in response to the metal object being detected in the interrogation zone.

2. The security system of claim 1, wherein to determine whether the metal object is detected in the interrogation zone, the security controller is further configured to:

determine a difference between signal levels of the interrogation signals at a first antenna of the second set of antennas and a second antenna of the second set of antennas or at a first antenna of the first set of antennas and a second antenna of the first set of antennas;

compare the difference between the signal levels to a threshold; and determine whether the metal object is detected in the interrogation zone further in response to the difference between the signal levels being greater than the threshold.

3. The security system of claim 2, wherein the difference between the signal levels is an absolute value of the difference between the signal levels.

4. The security system of claim 2, wherein the first antenna of the first set of antennas is vertically positioned above the second antenna of the first set of antennas and the first antenna of the second set of antennas is vertically positioned above the second antenna of the second set of antennas.

5. The security system of claim 1, further comprising:

a plurality of digital potentiometers communicatively coupled with the security controller, the first set of antennas, and the second set of antennas, and configured to null the interrogation signals received by the first set of antennas or the second set of antennas in response to the reception of the interrogation signals via the plurality of digital potentiometers.

6. The security system of claim 5, wherein the plurality of digital potentiometers may be calibrated to null the interrogation signals a number of times by matching signal levels of the interrogation signals received by the first set of antennas or the second set of antennas.

7. The security system of claim 1, further comprising:

a first pedestal comprising the first set of antennas; and a second pedestal comprising the second set of antennas.

8. The security system of claim 1, further comprising:

a memory storing instructions for controlling the security system, wherein the security controller is one or more processors further communicatively coupled with the memory.

9. A method of controlling a security system comprising a plurality of pedestals with a first set of antennas and a second set of antennas spaced from the first set of antennas to form an interrogation zone, the method comprising:

alternating transmission of interrogation signals between the first set of antennas and the second set of antennas;

alternating reception of the interrogation signals between the second set of antennas and the first set of antennas to coordinate with the transmission of the interrogation signals;

determining whether a metal object is detected in the interrogation zone based on comparing reception of the interrogation signals by the second set of antennas to reception of the interrogation signals by the first set of antennas; and generating and sending an alarm signal in response to the metal object being detected in the interrogation zone.

10. The method of claim 9, wherein determining whether the metal object is detected in the interrogation zone,—further comprises:

determining a difference between signal levels of the interrogation signals at a first antenna of the second set of antennas and a second antenna of the second set of antennas or at a first antenna of the first set of antennas and a second antenna of the first set of antennas;

comparing the difference between the signal levels to a threshold; and determining whether the metal object is detected in the interrogation zone further in response to the difference between the signal levels being greater than the threshold.

11. The method of claim 10, wherein the difference between the signal levels is an absolute value of the difference between the signal levels.

12. The method of claim 10, wherein the first antenna of the first set of antennas is vertically positioned above the second antenna of the first set of antennas and the first antenna of the second set of antennas is vertically positioned above the second antenna of the second set of antennas.

13. The method of claim 9, further comprising:

nulling the interrogation signals received by the first set of antennas or the second set of antennas in response to the reception of the interrogation signals via a plurality of digital potentiometers communicatively coupled with the first set of antennas and the second set of antennas.

14. The method of claim 13, wherein the plurality of digital potentiometers may be calibrated to null the interrogation signals a number of times by matching signal levels of the interrogation signals received by the first set of antennas or the second set of antennas.

15. The method of claim 9, wherein the first set of antennas are positioned in a first pedestal, and the second set of antennas are positioned in a second pedestal.

16. A computer-readable medium storing computer executable instructions of controlling a security system, comprising instructions to:

alternate transmission of interrogation signals by a first set of antennas of a plurality of pedestals to a second set of antennas of the plurality of pedestals spaced from the first set of antennas to form an interrogation zone and by the second set of antennas to the first set of antennas;

alternate reception of the interrogation signals between the second set of antennas and the first set of antennas to coordinate with the transmission of the interrogation signals;

determine whether a metal object is detected in the interrogation zone based on comparing reception of the interrogation signals by the second set of antennas to reception of the interrogation signals by the first set of antennas; and generate and send an alarm signal in response to the metal object being detected in the interrogation zone.

17. The computer-readable medium of claim 16, wherein to determine whether a metal object is detected in the interrogation zone, the instructions further comprise to:

determine a difference between signal levels of the interrogation signals at a first antenna of the second set of antennas and a second antenna of the second set of antennas or at a first antenna of the first set of antennas and a second antenna of the first set of antennas;

compare the difference between the signal levels to a threshold; and determine whether the metal object is detected in the interrogation zone further in response to the difference between the signal levels being greater than the threshold.

18. The computer-readable medium of claim 17, wherein the difference between the signal levels is an absolute value of the difference between the signal levels.

19. The computer-readable medium of claim 17, wherein the first antenna of the first set of antennas is vertically positioned above the second antenna of the first set of antennas and the first antenna of the second set of antennas is vertically positioned above the second antenna of the second set of antennas.

* * * * *